US005946731A

United States Patent [19]

Finlay et al.

[11] Patent Number: 5,946,731

[45] Date of Patent: Sep. 7, 1999

[54] MULTI-LAYERED CHEERLEADER SOCK

[76] Inventors: Mary Beth Finlay, 15344 E. Mustang Dr., Fountain Hills, Ariz. 85268; Barbara R. Zabel, 2818 E. Aster Dr., Phoenix, Ariz. 85032

[21] Appl. No.: 09/052,176

[22] Filed: Mar. 31, 1998

[51] Int. Cl.[6] ..... A41B 11/00

[52] U.S. Cl. ..... 2/239; 2/409

[58] Field of Search ..... 2/239, 409; 66/178 R, 66/178 A, 182, 194, 185, 188

[56] References Cited

U.S. PATENT DOCUMENTS

| | | | |
|---|---|---|---|
| D. 29,087 | 7/1898 | Brown | 2/239 |
| 876,797 | 1/1908 | Gilbert | 2/239 |
| 1,075,864 | 10/1913 | Scott | 2/239 |
| 2,578,895 | 12/1951 | Meengs et al. | 2/239 |
| 2,685,187 | 8/1954 | Deans | 2/239 |
| 2,926,512 | 3/1960 | Robertson | 2/239 |
| 3,039,282 | 6/1962 | Hayes | 2/239 |
| 5,035,008 | 7/1991 | Schneider | 2/239 |
| 5,125,116 | 6/1992 | Gaither et al. | 2/239 |
| 5,307,522 | 5/1994 | Throneburg et al. | 2/239 |
| 5,417,091 | 5/1995 | Moser | 2/239 |

OTHER PUBLICATIONS

Sears Wishbook Catalog–Dec. 1985, p. 294, item 8.

J.C. Penney—Christmas (Dec. 1975) Catalog, p. 169, item (e).

Cabelas, Annual 1994 Fall Catalog, p. 141, socks.

*Primary Examiner*—Gloria Hale

[57] ABSTRACT

A cheerleader sock including a one-piece sock that has dual cuff portions. Each cuff portion of the pair of socks has one cuff portion formed of yarn that has a different thread and color from another cuff portion.

2 Claims, 2 Drawing Sheets

MULTI-LAYERED CHEERLEADER SOCK

BACKGROUND OF THE INVENTION

1. Field of the Invention

The present invention relates to a Multi-layered cheerleader sock and more particularly pertains to providing a colored layered appearance in a pair of socks to replace wearing two pair of socks.

2. Description of the Prior Art

The use of a pair of socks is known in the prior art. More specifically, pair of socks heretofore devised and utilized for the purpose of accessories an outfit are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,125,116 to Gaither and Richard discloses a sock with simulated stirrup. U.S. Pat. No. 4,958,388 to Madden discloses socks with size indicating stripes. U.S. Pat. No. Des. 294,771 to Good et al. discloses a sock. U.S. Pat. No. 3,995,322 to Cheseboro discloses a cushion top sock. U.S. Pat. No. 4,104,892 to Thorneburg discloses a cushioned sole tube sock and method. Lastly, U.S. Pat. No. 329,324 to Stokely discloses a sock.

In this respect, the Multi-layered cheerleader sock according to the present invention substantially departs from the conventional concepts and designs of the prior art, and in so doing provides an apparatus primarily developed for the purpose of providing a colored layered appearance in a pair of socks.

Therefore, it can be appreciated that there exists a continuing need for a new and improved Multi-layered cheerleader sock which can be used for providing a colored layered appearance in a pair of socks. In this regard, the present invention substantially fulfills this need.

SUMMARY OF THE INVENTION

In view of the foregoing disadvantages inherent in the known types of pair of socks now present in the prior art, the present invention provides an improved cheerleader sock. As such, the general purpose of the present invention, which will be described subsequently in greater detail, is to provide a new and improved cheerleader sock which has all the advantages of the prior art and none of the disadvantages.

To attain this, the present invention essentially comprises a seamless knit sock. The sock is adapted for use with athletic shoes. The sock has a heel and foot and a cuff portion. The heel and foot portion are knit throughout from a first yarn and having a first color.

Also, the cuff portion has a lower portion and a an upper portion. The lower portion is adjacent the foot portion and extending outwardly therefrom. The upper portion is formed from a second yarn and interknit with an upper periphery of the lower portion. The upper portion has a second color.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cheerleader sock which has all the advantages of the prior art pair of socks and none of the disadvantages.

It is another object of the present, invention to provide a new and improved cheerleader sock which may be easily and efficiently manufactured and marketed.

It is a further object of th present invention to provide a new and improved cheerleader sock which is of a durable and reliable construction.

An even further object of the present invention is to provide a new and improved cheerleader sock which is susceptible of a low cost of manufacture with regard to both materials and labor, and which accordingly is then susceptible of low prices of sale to the consuming public, thereby making such Multi-layered Cheerleader sock economically available to the buying public.

Still yet another object of he present invention is to provide a new and improved cheerleader sock which provides in the apparatuses and methods of the prior art some of the advantages thereof, while simultaneously overcoming some of the disadvantages normally associated therewith.

Still another object of the present invention is to providing a colored layered appearance in a pair of socks.

Lastly, it is an object of the present invention to provide a new and improved one-piece sock that has dual cuff portions. Each cuff portion of the pair of socks has one cuff portion formed of yarn that has a different thread and color from the other cuff portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
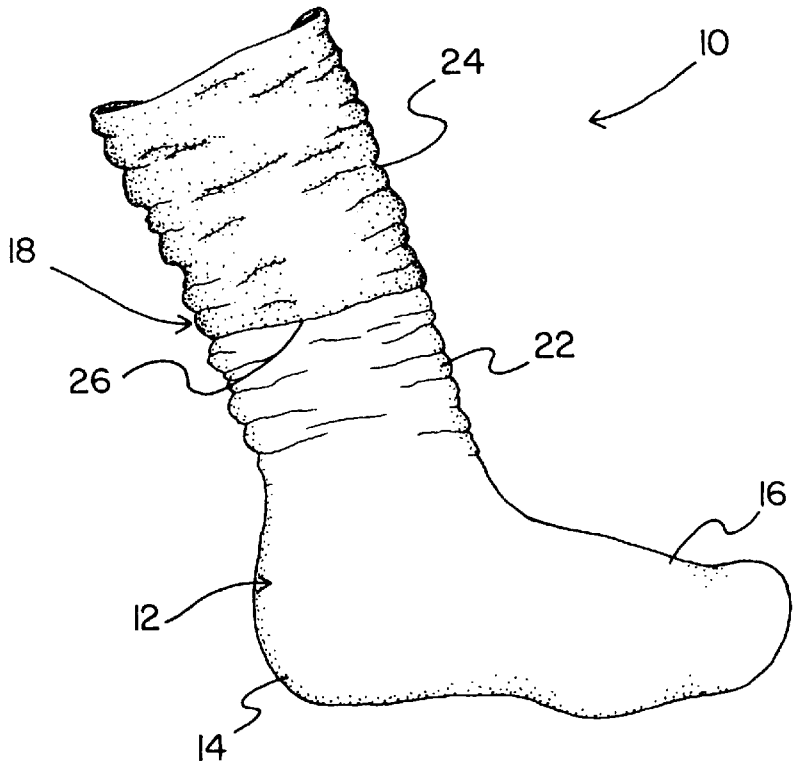
FIG. 1 is a perspective illustration of the preferred embodiment of the cheerleader sock constructed in accordance with the principles of the present invention.

With reference now to the drawings, and in particular to FIG. 1 thereof, a new and improved Multi-layered cheerleader sock embodying the principles and concepts of the present invention and generally designated by the reference numeral 10 will be described.

The present invention, the new and improved cheerleader sock, is comprised of a plurality of components. Such components in their broadest context include a seamless knit sock with an upper cuff. Such components are individually configured and correlated with respect to each other so as to attain the desired objective.

More specifically, the present invention includes a seamless knit sock 12 as shown in FIG. 1. The sock is adapted for use with athletic shoes. The sock has a heel 14 and foot 16 and an upper cuff portion 18. The heel and foot portion are knit throughout from a first yarn and having a first color.

Figure 2:
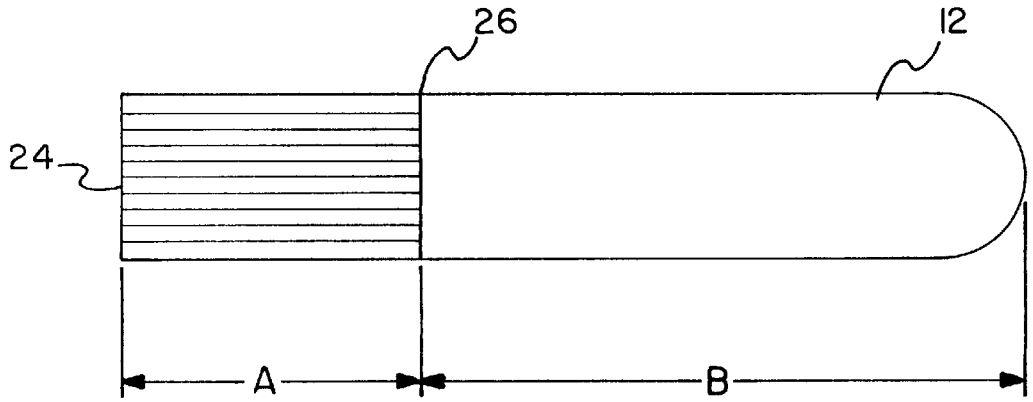
FIG. 2 is a top plan view of the cheerleader sock in a flat orientation.

Also, the upper cuff portion has a lower portion 22 and an upper portion 24. The lower cuff portion is adjacent the foot portion and extends outwardly from the foot portion, as shown in FIG. 2. The upper cuff portion is formed from a second yarn and interknit with an upper periphery 26 of the lower cuff portion. The upper cuff portion has a second color.

Lastly, the second yarn of the upper cuff portion has terry cloth yarn threads of greater thickness than terry yarn threads of the lower cuff portion.

Figure 3:
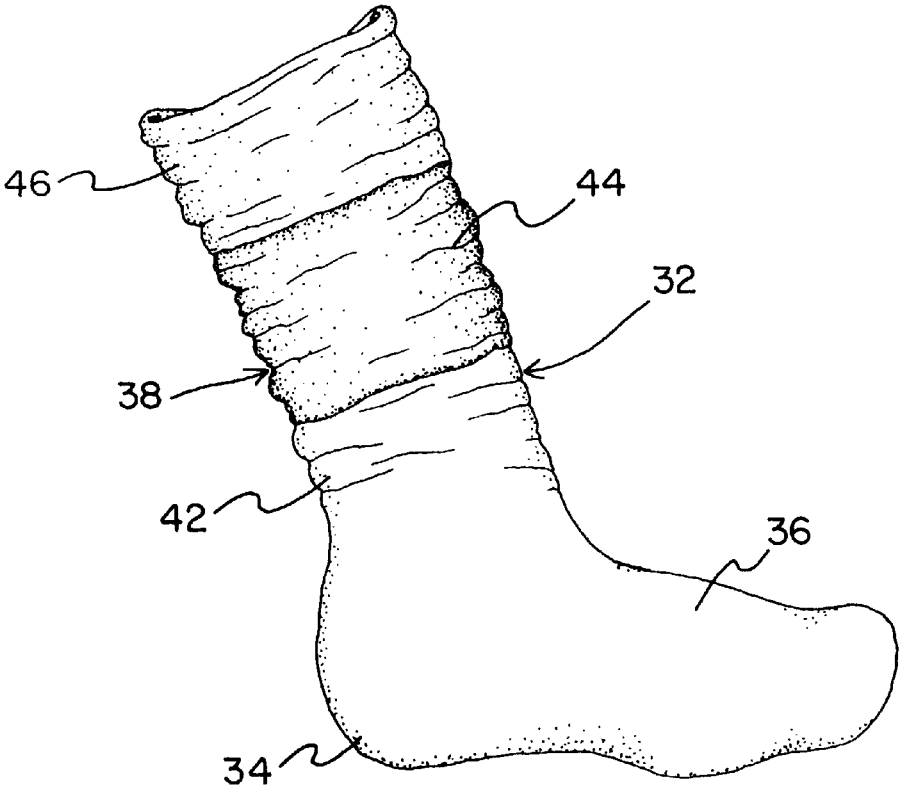
FIG. 3 is a perspective illustration of the alternative embodiment of the cheerleader sock constructed in accordance with the principles of the present invention.

Furthermore, an alternative embodiment 32 is provided. The alternative embodiment, as seen in FIG. 3 is a seamless knit sock adapted for use with athletic shoes. This embodiment, like the preferred embodiment has, a heel 34 and foot 36 and a cuff portion 38. The heel and foot portion, like the sock of FIG. 1, is knit throughout from a first yarn. The first yarn has a first color. The cuff portion has a lower cuff portion 42, an intermediate cuff portion 44, and an upper cuff portion 46. The lower portion, as seen in FIG. 3, is adjacent the foot portion and extends outwardly.

Figure 4:
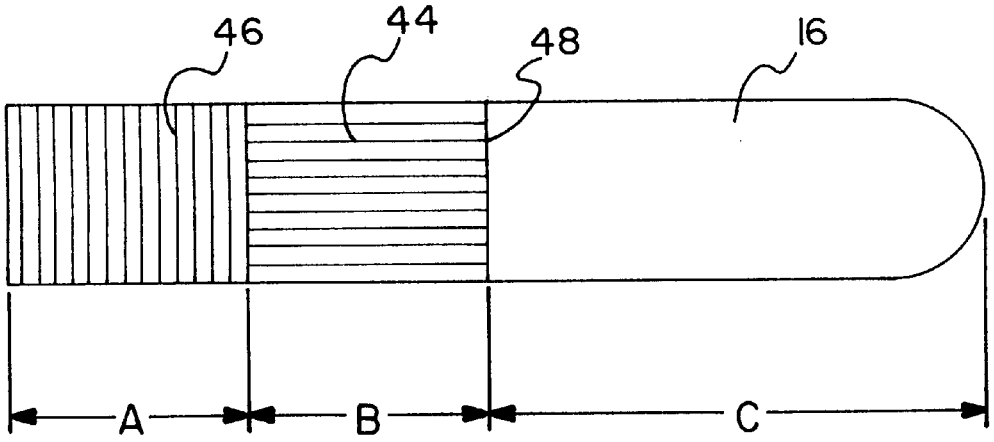
FIG. 4 is a top plan view of the alternative embodiment of the cheerleader sock in a flat orientation.

As illustrated in FIG. 4, the intermediate portion 44 is formed from a second yarn and interknit with an upper periphery 48 of the lower portion. The intermediate portion has a second color. The upper portion is formed from the first yarn and interknit with an upper periphery of the intermediate portion. The upper portion has the first color.

Finally, the second yarn of the intermediate portion of the alternative embodiment has terry cloth yarn threads. These threads are of greater thickness than terry yarn threads of the first cuff portion and the third cuff portion.

The present invention is a multi-layered sock for creating a colorful, layered appearance without the use of two or three pairs of socks. The multi-layered appearance is created when the upper portion of the cuff has a different color. The preferred embodiment invention will have heel and foot portion and the lower cuff portion formed of one yarn and having one color. The alternative embodiment of the present invention will have the identical structure with the intermediate and upper portions having different colors.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fashion sport sock comprising, in combination:

a seamless knit sock adapted for use with athletic shoes having a heel and foot and a cuff with an upper and a lower portion, the heel and foot portion being knit throughout from a first yarn and having a first color, the lower portion being adjacent the foot portion and extending outwardly therefrom, the upper portion being formed from a second yarn and interknit with an upper periphery of the lower portion, the upper portion having a second color, the second yarn of the upper portion having terry yarn threads of greater thickness than terry yarn threads of the lower portion.

2. A fashion sport sock comprising, in combination:

a seamless sock adapted for use with athletic shoes having a heel and foot and a cuff having an upper portion and an intermediate portion and a lower portion, the heel and foot portion being knit throughout from a first yarn and having a first color, the lower portion being adjacent the foot portion and extending outwardly therefrom, the intermediate portion being formed from a second yarn and interknit with an upper periphery of the lower portion, the intermediate portion having a second color, the lower portion being formed from the first yarn and interknit with an upper periphery of the intermediate portion, the upper portion having the first color, the second yarn of the intermediate portion having terry yarn threads of greater thickness than terry yarn threads of the lower portion and the upper portion.

* * * * *